US007422657B2

(12) United States Patent
Gustavsson et al.

(10) Patent No.: US 7,422,657 B2
(45) Date of Patent: Sep. 9, 2008

(54) METHOD FOR THE FEED OF CELLULOSE CHIPS DURING THE CONTINUOUS COOKING OF CELLULOSE

(75) Inventors: Lennart Gustavsson, Karlstad (SE); Vidar Snekkenes, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 161 days.

(21) Appl. No.: 10/504,948

(22) PCT Filed: Mar. 12, 2003

(86) PCT No.: PCT/SE03/00407

§ 371 (c)(1),
(2), (4) Date: Aug. 16, 2004

(87) PCT Pub. No.: WO03/078727

PCT Pub. Date: Sep. 25, 2003

(65) Prior Publication Data

US 2006/0037723 A1 Feb. 23, 2006

(30) Foreign Application Priority Data

Mar. 15, 2002 (SE) ..... 0200790

(51) Int. Cl.
*D21C 7/06* (2006.01)
*D21C 3/24* (2006.01)

(52) U.S. Cl. ..... 162/52; 162/17

(58) Field of Classification Search ..... 162/52, 162/236, 246, 17, 19, 29, 41; 222/368
See application file for complete search history.

(56) References Cited

U.S. PATENT DOCUMENTS

| | | | | | |
|---|---|---|---|---|---|
| 3,681,192 | A | * | 8/1972 | Reinhall | 162/246 |
| 4,284,120 | A | | 8/1981 | Gloersen | |
| 4,954,219 | A | | 9/1990 | Gloersen | |
| 5,476,572 | A | * | 12/1995 | Prough | 162/246 |
| 5,635,025 | A | * | 6/1997 | Bilodeau | 162/17 |
| 5,968,314 | A | * | 10/1999 | Prough | 162/52 |

(Continued)

FOREIGN PATENT DOCUMENTS

JP 2001329479 A * 11/2001

(Continued)

*Primary Examiner*—José A Fortuna
(74) *Attorney, Agent, or Firm*—Rolf Fasth; Fasth Law Offices

(57) ABSTRACT

The method is for feeding a chips-slurry from a low-pressure to a high-pressure system during the continuous cooking of chemical cellulose pulp. The feed takes place through a sluice feeder 53' between these systems. The sluice feeder is provided with a rotor with through-pockets 1, 2 that are alternately connected with the low-or the high-pressure system. A recirculation line 54', that has a high-pressure pump 57', extends from the first outlet **53*b*' of the sluice feeder to the second inlet 53*c*'** of the sluice feeder for transporting the fluid that has been expelled from the pockets of the sluice feeder when these are located in their first position. The fluid expels the chips mixture from the pockets of the sluice feeder in their second position and is essentially exclusively constituted by the fluid that has been expelled from the pockets in their first position.

8 Claims, 6 Drawing Sheets

U.S. PATENT DOCUMENTS

| | | | | |
|---|---|---|---|---|
| 6,120,646 | A * | 9/2000 | Snekkenes et al. | 162/236 |
| 6,280,567 | B1 * | 8/2001 | Gustavsson et al. | 162/14 |
| 6,332,950 | B1 * | 12/2001 | Snekkenes et al. | 162/41 |
| 6,436,233 | B1 * | 8/2002 | Barrett et al. | 162/52 |
| 6,447,645 | B1 * | 9/2002 | Barrett et al. | 162/233 |
| 7,112,256 | B2 * | 9/2006 | Snekkenes et al. | 162/19 |
| 7,279,070 | B2 * | 10/2007 | Snekkenes et al. | 162/71 |
| 2001/0000588 | A1 * | 5/2001 | Snekkenes | 162/237 |
| 2002/0059991 | A1 * | 5/2002 | Barrett et al. | 162/17 |
| 2003/0000660 | A1 * | 1/2003 | Gustavsson | 162/24 |
| 2004/0060672 | A1 * | 4/2004 | Snekkenes et al. | 162/19 |
| 2005/0061464 | A1 * | 3/2005 | Snekkenes | 162/242 |
| 2005/0279468 | A1 * | 12/2005 | Stromberg | 160/52 |
| 2006/0037723 | A1 * | 2/2006 | Gustavsson et al. | 162/52 |
| 2006/0070709 | A1 * | 4/2006 | Snekkenes et al. | 162/19 |
| 2007/0095490 | A1 * | 5/2007 | Snekkenes | 162/17 |
| 2007/0187053 | A1 * | 8/2007 | Snekkenes et al. | 162/19 |

FOREIGN PATENT DOCUMENTS

| | | | |
|---|---|---|---|
| WO | WO9942653 | A1 | 8/1999 |
| WO | WO 3078727 | A1 * | 9/2003 |
| WO | WO 2005064078 | A1 * | 7/2005 |

* cited by examiner

METHOD FOR THE FEED OF CELLULOSE CHIPS DURING THE CONTINUOUS COOKING OF CELLULOSE

PRIOR APPLICATION

This application is a U.S. national phase application based on International Application No. PCT/SE03/00407, filed 12 Mar. 2003, claiming priority from Swedish Patent Application No. 0200790-4, filed 15 Mar. 2002.

TECHNICAL AREA

The invention concerns a method for the feed of cellulose chips during the continuous cooking of cellulose.

THE PRIOR ART

When cooking cellulose chips in continuous digesters, the chips are transported from a feed system at atmospheric pressure, or a pressure slightly over atmospheric pressure, by what is known as a "transfer flow" to an impregnation vessel or a digester at a considerably higher pressure. Transport in the transfer flow is made possible by the chips being combined with a transport fluid, preferably a process fluid, to form a slurry; the transport fluid being subsequently separated from the chips in separation equipment, normally denoted the "top separator", when it has reached the impregnation vessel or the digester. The transport fluid is returned to the feed system through a return line. The transfer flow has for many years comprised a special type of sluice feeder, known as a high-pressure feeder, that will hereafter be denoted the "HP feeder". This feeder has been specially designed such that it can resist the large differences in pressure that are present between the two systems. The HP feeder is provided with a rotor having symmetrical through-pockets that come into contact during rotation, alternately with the low-pressure system and the high-pressure system, without allowing any communication between these two systems. The chips can in this way be taken from a system at zero pressure or at a low pressure, typically 0-4 bar (abs), and they can be fed via the HP feeder into a system at a considerably higher pressure, typically 7-20 bar (abs).

The method currently used for filling the pocket in the HP feeder, used for example in U.S. Pat. No. 6,120,646, is to establish a large flow of fluid through what is known as a "chute flow" such that the transport fluid in this way carries chips with it into the pocket. There is thus a certain amount of the transport fluid in this chute flow that passes directly through the pocket during the filling phase. Chips are expelled from the pocket by the same principle for onwards transport up to the impregnation vessel or the digester in what is known as a transfer flow, something that in principle means that the transfer flow carries with it a larger quantity of transport fluid than is actually desirable. It is therefore necessary to withdraw (as a minimum amount) the excess transport fluid from the chips before they are fed down into the treatment vessel. The transport fluid that is withdrawn is returned to the HP feeder in order to expel chips again from a filled pocket in the HP feeder.

Very high liquid/wood ratios, L/W ratios, are created through both of these flows, and this has long been regarded as necessary in order to transport the chips. It has also been believed that the HP feeder requires these high fluid flows in order to function satisfactorily with respect to, among other aspects, the degree of filling and the expulsion of the chips from the pocket at the high-pressure position, particularly when it is required to increase the production capacity and when the rotation of the HP feeder has consequently been increased. This way of thinking has resulted in it being normal for many years to establish a L/W ratio in the chute flow of between 5-10 tones per tonne, and a ratio as high as 15-25 tones/tonne in the transport flow. Thus, these flows transport very high quantities of fluid, something that has resulted in pumps, pipes, valves and regulators for these flows becoming major expenses with respect to both investment and operation. This means that there are particularly strong reasons for discovering a method for transporting the chips from the input system to the digester system without these fluid flows, and this is the primary aim of the invention.

Surprisingly, it has now become clear that it is possible with a method according to the present invention to fill and empty the HP feeder without the large fluid flows that have previously been considered necessary. Experiments have shown that only a minimum of fluid is required for the purpose, namely: as much fluid that naturally fills the spaces that exist between the chips in the column of chips in the chip chute. In order to reduce the friction between the column of chips and the wall of the chute, however, somewhat more fluid than this minimum is used, typically 10% more that the smallest amount. This corresponds to a L/W ratio in the range 5-10:1.

Most of the cooking methods that have been developed in recent years have been directed towards establishing high L/W ratios both during the impregnation phase and during the cooking phase, typically approaching 5-10, which is to be compared with the ratios of 2.5-4 required according to older cooking methods. When using a method according to the present invention, only a minimum of fluid is used to transport the chips in the transfer line, and thus all the fluid can be allowed to accompany the chips to the subsequent treatment vessel. Thus, a return line for transport fluid is not necessary, nor are the pumps, valves and instruments associated with such a line, something that makes the input system a great deal cheaper. It will be clear to one skilled in the arts that it is possible to avoid the separation equipment at the top of the treatment vessel if this is desirable from the point of view of the process, something that ensures that the investment cost for a digester with an input system according to this invention is even further reduced.

THE PURPOSE AND AIM OF THE INVENTION

The aim of the invention is to offer a method during the transport of a chips mixture from an input system that works at a first low pressure and that comprises an HP feeder for transfer of the chips mixture through a sluice to a treatment vessel in a digester system for the continuous cooking of chemical cellulose pulp that functions at a second, higher pressure and where the input system does not comprise a chute flow nor does it comprise a return line in the transport flow.

A further aim is to make an input system possible where a top separator at the top of the impregnation vessel or the digester is not necessary.

BRIEF DESCRIPTION OF THE INVENTION

The method according to the invention can be applied in both single-vessel and in double-vessel digester systems of digesters of both steam-phase and hydraulic type. In one preferred embodiment the method is applied such that the fluid that feeds the chips mixture from the pockets of the HP feeder when these pockets are positioned in the emptying position in a second position is constituted by the fluid that has been expelled from the pockets of the HP feeder when these are positioned in a filling position in a first position. The chips mixture is transported from the HP feeder to a treatment vessel via a transfer line and the method is characterised in that the L/W ratio in the chips mixture is essentially maintained at the same level in this transfer line as the level in the position immediately before the feed into the HP feeder. The method does not require any extra addition of transport fluid to the HP feeder in order to extract the chips, which ensures that the return line for transport fluid from separation equipment at the top of the treatment vessel is not necessary.

According to one alternative embodiment, the method is applied to processes with high L/W ratios during the impregnation or the cooking, also making separation equipment at the top of the treatment vessel unnecessary.

The HP feeder can be located in an input system in order to promote a chips mixture from a chip chute with a preceding steaming vessel, which can be constituted by an impregnation vessel or by a digester. The HP feeder can also be located at a position between two treatment vessels, which can be constituted by a first impregnation vessel, at atmospheric pressure, and a second, pressurised, digester.

Further characteristics and aspects of the invention, together with its advantages, are made clear by the accompanying claims and by the following detailed description of some embodiments.

DETAILED DESCRIPTION OF THE INVENTION

Description of the drawings:

FIG. 1 shows schematically a feed system according to the prior art with an HP feeder 33 together with a chips flow 34 and a transfer flow (6*a*, 45). The transfer flow is constituted by a transfer line 6*a* for transport of chips that have been formed into a slurry with a transport fluid, and a return line 45 for the transport fluid. The transfer line 6*a* connects at its upper end to a top separator 47 at the top of a treatment vessel 48 where the excess transport fluid is separated from the chips and subsequently returned to the HP feeder 33 through the return line 45. The top separator 47 is here symbolised by a downwardly fed version in a hydraulic digester, but it can just as well be constituted by a upwardly fed top separator in a steam/fluid phase digester, a strainer arrangement at the top of a hydraulically filled treatment vessel or any other separation equipment arranged in the transfer line or at the upper section of the treatment vessel.

Figure 2B:
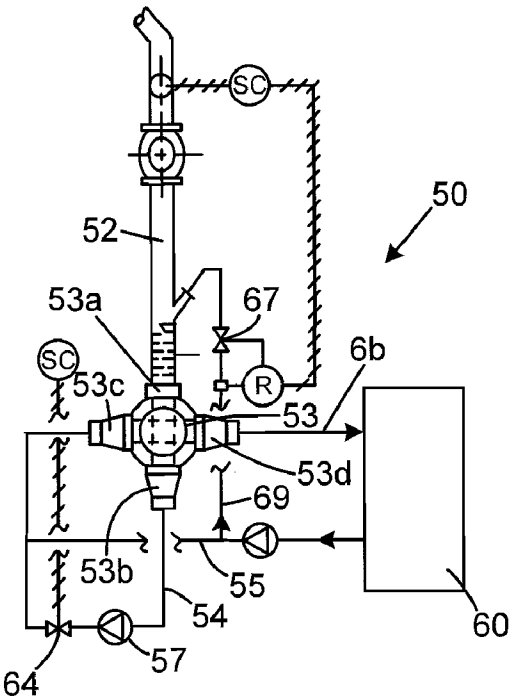
FIG. 2b Prior Art
FIGS. 2*a*, 2*b* show schematically a feed system according to a technology developed later comprising both a chute flow and a transfer flow with return line (according to U.S. Pat. No. 6,120,646).
Figure 2A:
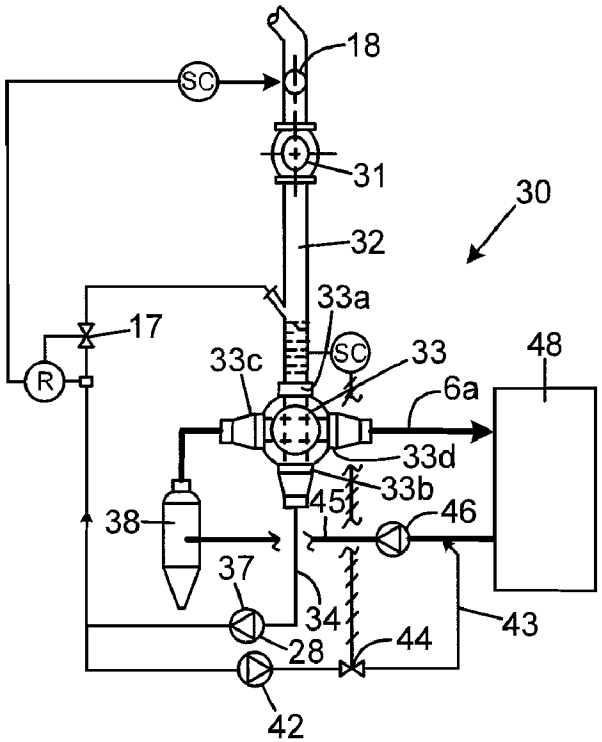
FIG. 2a Prior Art

Two examples of feed systems are shown in FIGS. 2*a* and 2*b* comprising both a chute flow and a transfer flow with return line according to U.S. Pat. No. 6,120,646. These examples can be said to constitute examples of feed systems according to the prior art developed at a later stage. The reference numerals in each drawing are specified according to the following order (FIG. 2*a*, FIG. 2*b*). The chute flow in FIG. 2*a* is constituted by the line 34 and the associated pump 37, while the chute flow in FIG. 2*b* is equivalent to the line 69. One of the characteristics of the present patent is the omission of a strainer, known as a "bottom strainer", between the high-pressure feeder and the line of the chute flow (34, 69) in what can be said to constitute the bottom of the pocket of the HP feeder, when this is located at its filling position at its first position. The return lines (45, 55) in the transfer flow from the treatment vessel (48, 60) are also seen in the drawings. The L/W ratio in the chip chute (32, 52) can be controlled by adjusting the addition of fluid in the chute flow (34, 69). In order to ensure a secure feed of chips in the chip chute (32, 52) the L/W ratio normally lies in the interval from 5-10:1. A degree of filling in the chip chute (32, 52) of 80-85% according to what is specified in U.S. Pat. No. 6,120,646 is equivalent to an L/W ratio of 5.8-6.3:1 when the density of chips is 145 kg/m$^3$, and a L/W ratio of 4.24-6:1 when the density of the chips is 200 kg/m$^3$. The transport fluid that is added at the second inlet (33*c*, 53*c*) of the HP feeder in order to expel the chips from the pocket arrives through the return line (45, 55) from the treatment vessel (48, 60) when the pocket is in its second position, that is, when the chip pocket opens onto the high-pressure system. The transport fluid is used in order to make transport of the chips to the top of the treatment vessel (48, 60) possible, and very high L/W ratios, typically between 15-20:1 have traditionally been locally established in the transfer line (6*a*, 6*b*) between the high-pressure feeder (33, 53) and the top separator (not shown in the drawings) by addition of this transport fluid. A quantity of transport fluid is subsequently withdrawn at the top separator such that the L/W ratio becomes between 2.5-5 when the chips are fed downwards into the treatment vessel. The embodiment according to FIG. 2*b* is the one that lies closest to the present invention, since the recirculation line 54 from the first outlet 53*b* of the HP feeder is connected with the second inlet 53*c* of the HP feeder, although this is connected via the return line 55 in the transfer flow.

Figure 3:
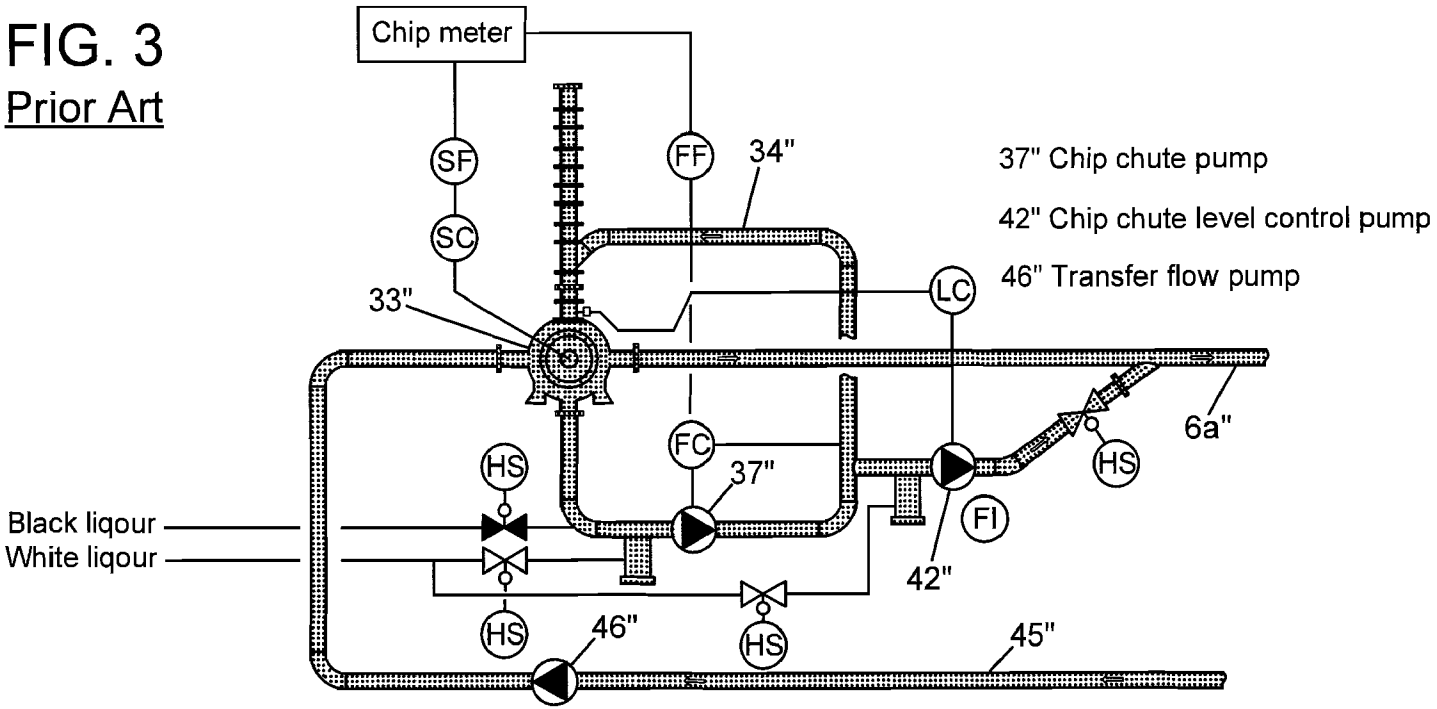
FIG. 3 Prior Art
FIG. 3 shows in detail an arrangement around the HP feeder (according to U.S. Pat. No. 6,120,646).

An arrangement equivalent to FIG. 2*a* around the HP feeder 33 is shown in more detail in FIG. 3 with the chute flow 34 and the transfer flow (6*a*, 45) together with some of the pumps (37, 42, 46), valves (HS) and instruments (SF, SC, LC, FC, FI, FF) that are required to control this arrangement.

Figure 1:
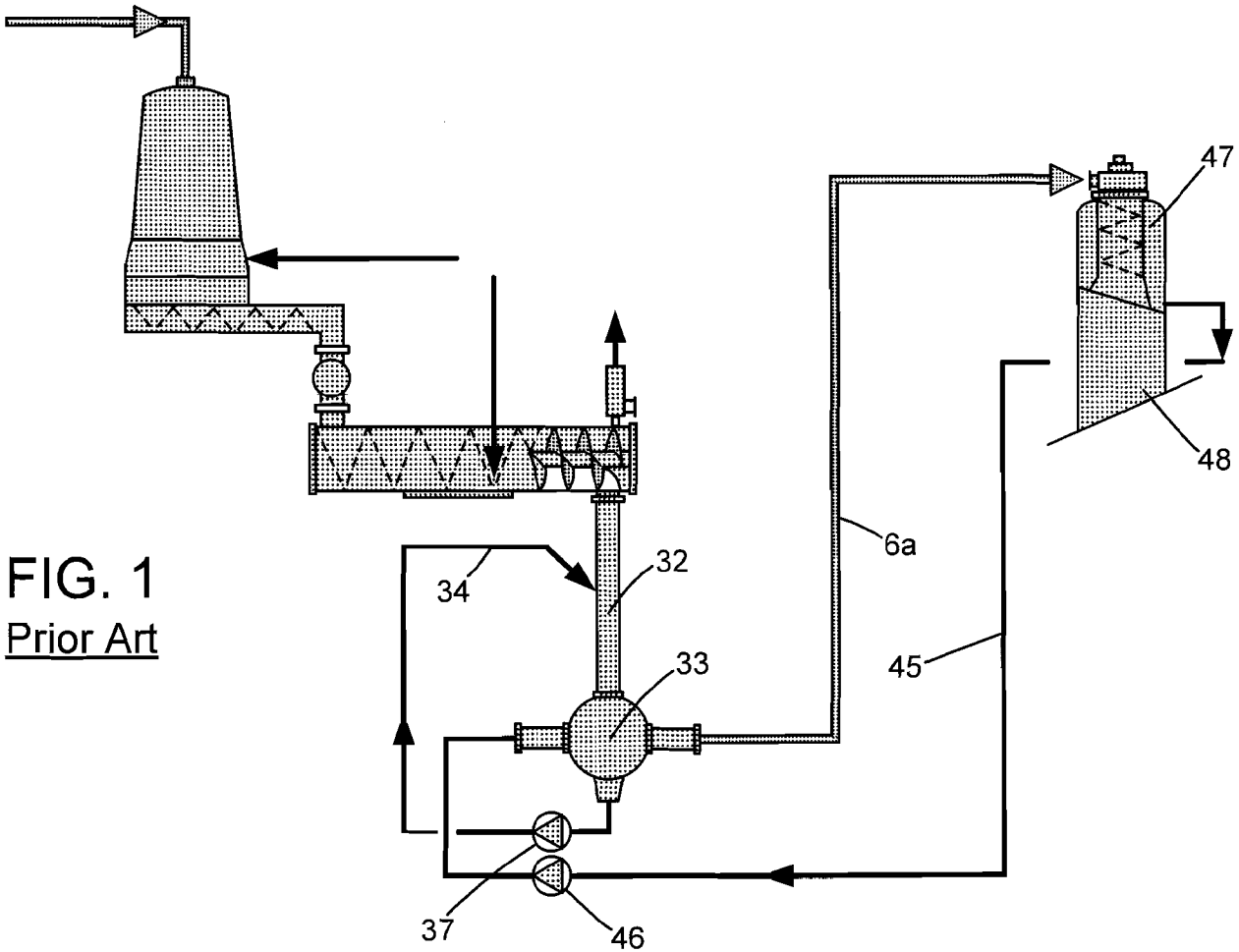
FIG. 1 Prior Art
FIG. 1 shows schematically a conventional feed system with an HP feeder together with a chip chute and a transfer flow.
Figure 4:
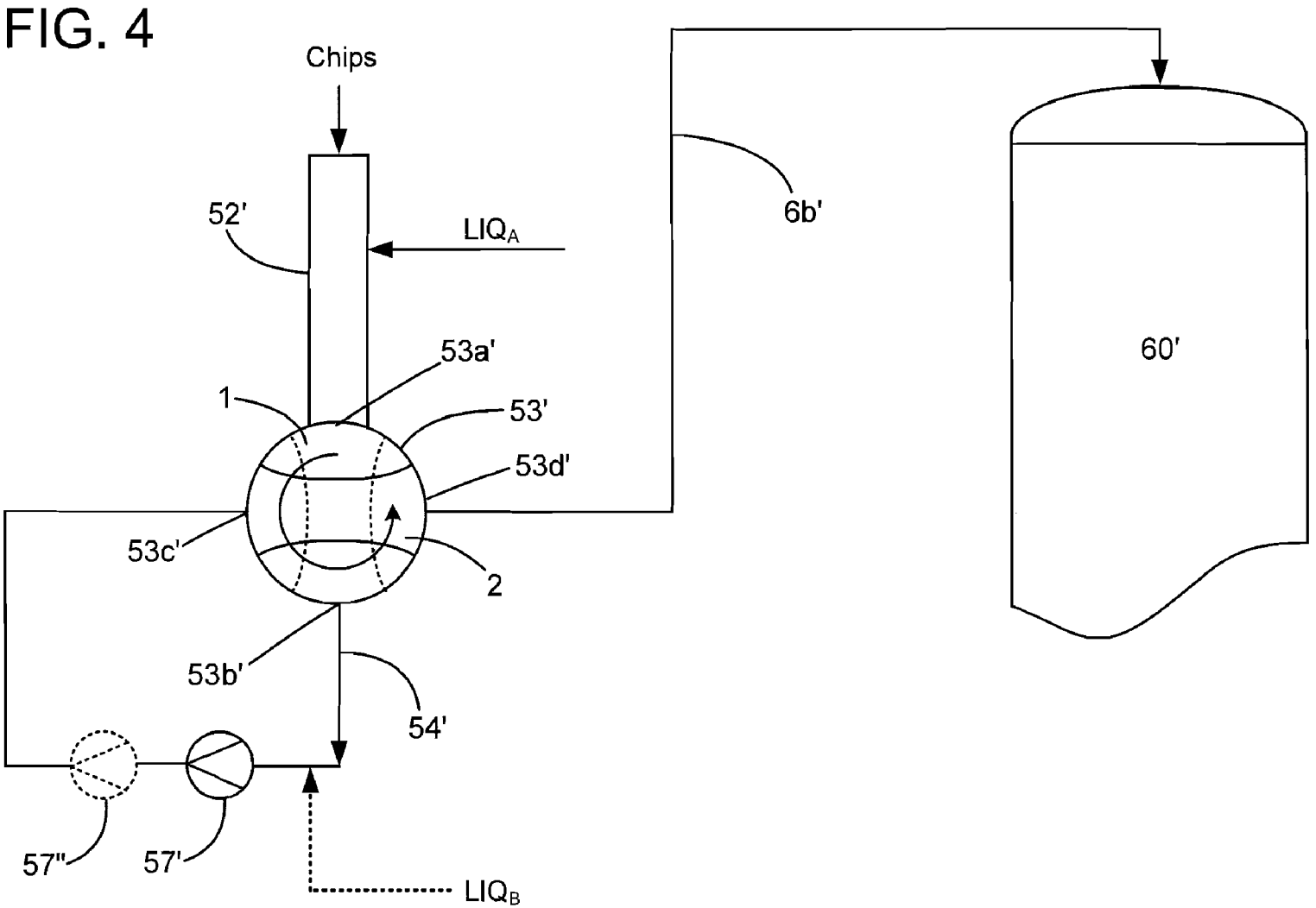
FIG. 4 shows one preferred embodiment of a feed system according to the invention.

FIG. 4 shows one preferred embodiment of a feed system according to the invention. Against the background of the prior art, where an arrangement according to FIG. 2*b* of U.S. Pat. No. 6,120,464 is that which approaches most closely to the invention, the same reference numerals are used in FIG. 4 as those used in FIG. 2*b*. As is the case in U.S. Pat. No. 6,120,464, the HP feeder in the present invention can preferably be constructed without any bottom strainer, but it can also be the case that the HP feeder has a bottom strainer according to older systems. The HP feeder 53' is fed with a mixture of chips and fluid from a chip chute 52' where an L/W ratio of between 4-10:1 is established through an active addition of fluid $LIQ_A$. It is appropriate that this fluid $LIQ_A$ is constituted by a process fluid such as impregnation fluid or cooking fluid. This is particularly advantageous with the method according to the invention since the fluid that is added in the chip chute 52' in order to establish a desired L/W-ratio accompanies the chips in the transfer line 6*b*' and, if it is desired, can also accompany the chips down into the treatment vessel 60'. It will be clear to one skilled in the arts that it is thereby possible to create under highly controlled conditions specific process conditions at an early stage of the process, that is, as early as the feed phase. This contrasts with conventional feed systems in which large quantities of transport fluid are separated from the chips at the top of the treatment vessel as a consequence of the very high L/W ratios that are locally established in the transfer line. Thus, it is no longer necessary to withdraw any of the fluid from the chips at the top of the treatment vessel, something that means that the expensive top separator (47 in FIG. 1) and the return line (55 in FIG. 2*a*) for the withdrawn transport fluid are no longer necessary. On the other hand, it is of course possible to withdraw a quantity of fluid if this is desirable from the point of view of the process, in order to achieve in this way an exchange of fluid for the chips mixture at the top separator. Further use of the process fluid withdrawn, if any, is described with reference to FIG. 5, but it is also valid for this embodiment.

A conventional HP feeder 53' follows the chip chute equipped with a rotor with symmetrically placed through-pockets (1, 2) that during rotation are alternately placed in contact with the chip chute 52' and the transfer line 6*b*'. When one of the pockets of the rotor through rotation gradually opens towards the chip chute 52', it is filled with the fluid that in the previous position expelled the chips mixture into the circulation line 6*b*'. At the same time, the pocket facing the equivalent circulation line 54' opens, and an open channel is created through the HP feeder. The pocket is in its first location when it is located in this filling position. Under the influence of one or more high-pressure pumps 57', 57" or one pump with several pumping stages in the circulation line 54' together with the static pressure that is established by the column 52' of fluid in the chip chute, the fluid in pocket 1 will be sucked out/expelled while the chips mixture is fed into the pocket at the same time. Since there is no chute flow with forced flow of fluid as there was in earlier methods, the chips and the fluid move down through the chip chute at the same speed. This means that the chips mixture is fed into the pocket 1 with a maintained L/W ratio, in contrast with earlier methods in which the forced flow of fluid carried chips with it into the pocket, causing in this manner a reduction in the L/W ratio. A further reduction in L/W ratio is obtained with the earlier methods of operation at the emptying position when the chips are expelled into the transfer line 6*b* with the aid of the transport fluid returned from the top separator. This reduction in L/W ratio, when the pocket in its second position is located at the emptying position, can be avoided with a method according to the present invention since it has been shown that expulsion of the chips does not require the addition of extra fluid in the circulation line 54'. Emptying of the pocket occurs according to the same principle as at the filling position in that a pocket 2 filled with chips mixture opens at the same time onto the transfer line 6*b*' and the high-pressure side of the circulation line 54' such that an open channel is formed and fluid from the circulation line 54' can expel the chips mixture into the transfer line 6*b*'. Thus, it is possible both to fill and to empty the pockets in the HP feeder without either the chute flow or the transfer flow, and this is the principle aim of the invention.

It can occasionally be desirable from the point of view of the process to add a makeup fluid $LIQ_B$ to the circulation line 54' at a point that is located between the hiqh-pressure pump 57 and the first outlet 53'. Exclusively using the makeup fluid $LIQ_E$ and the expulsion fluid from the first outlet 53' pumped by the high-pressure pump 57 to the second inlet 53*c*' to expel the chips mixture from a pocket of the sluice feeder into the transfer line shown in FIG. 4. This makeup fluid $LTQ_B$ is characterised in that it is not in any way a withdrawal from subsequent separation equipment connected to the treatment vessel 60'. Neither is the makeup fluid $LIQ_B$ constituted in any way by a withdrawal from a strainer section at the upper part of a hydraulically tilled treatment vessel, which strainer section is to be equivalent to a top separator. It is characteristic for the addition of a makeup fluid $LIQ_B$ that the amount that is added to the circulation line 54' results in a limited increase in the L/W ratio in the transfer line 6*b*' such that the added makeup fluid $LIQ_B$ does not exceed 50%, preferably less than 40% and more preferably less than 30%, of the L/W ratio in the chip chute 52' and never in such an amount that the L/W ratio in the transfer line 6*b*' exceeds 10:1. The makeup iluid $LIQ_B$ can be constituted by white liquor, black liquor, green liquor, or it may contain chemicals that promote the process or increase the yield such as cellulose derivatives, icr example CMC, organic suiphides such as carbon disuiphide, mercaptides, etc., AQ derivatives or other substances.

Figure 5:
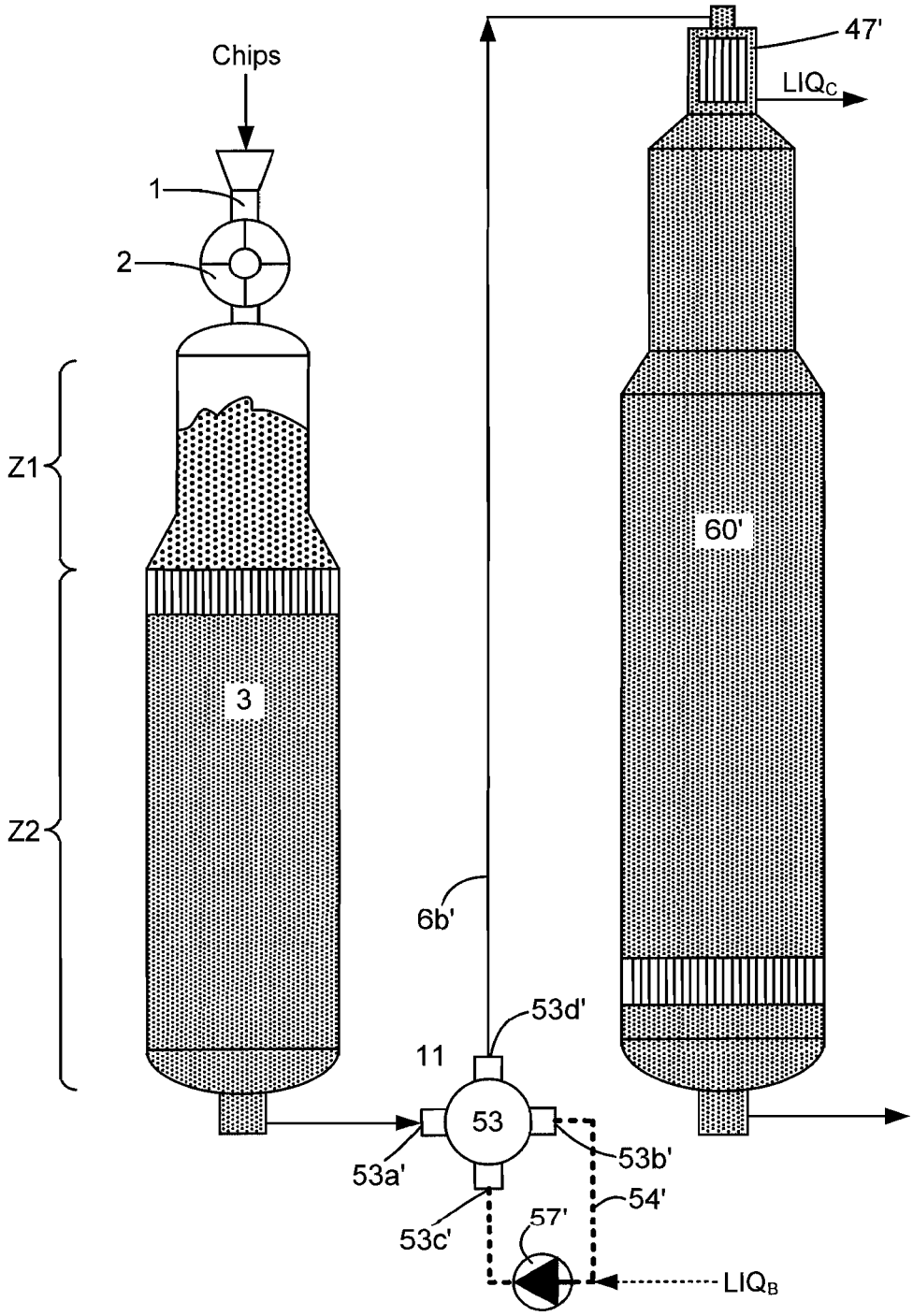
FIG. 5 shows an alternative embodiment according to the invention in which the method is applied for an HP feeder located between two treatment vessels.

FIG. 5 shows an alternative embodiment in which the method is applied to an HP feeder 53' located between two treatment vessels which can be constituted by a first impregnation vessel 3, essentially at atmospheric pressure, and a second, pressurised, digester 60'. The digester is symbolised in the figure by a steamphase digester displaying two strainer sections for the withdrawal of cooking fluid, but it is to be understood that the method is not limited to this. The method can also be applied in association with continuous digesters of various types, both steam phase and hydraulic types, with modified cooking systems (MCC, EMCC, Lo-Solids) and with ITC, and it can be used when manufacturing cellulose pulp according to both the sulphite method and the sulphate method. In the same way, deciduous wood, conifer wood, annuals (such as bagasse, reed canary grass, etc.) can constitute the raw material for cellulose. The term "impregnation vessel essentially at atmospheric pressure" is used here to denote an impregnation vessel in which the pressure at the top lies within the interval 1-3 bar (abs) and in which the inlet can be connected through some form of chip feed 2 directly to a chips pocket or other chips magazine 1 in an feed system. This impregnation vessel 3 can be designed such that the chips are first steamed during their downward passage through the vessel at an upper section Z1 and are subsequently impregnated in impregnation fluid in a lower section Z2 of the impregnation vessel in order to be subsequently fed onwards through the HP feeder 53' to the digester 60'. Depending on such factors as the L/W ratio present at the bottom of the impregnation vessel 3 and the static pressure from the superior column of fluid, no special equipment is needed other than, possibly, an output scraper (not shown in the drawing) at the bottom of the impregnation vessel 3 in order to expel the chips. Just as in previous embodiments according to FIG. 4, in which the HP feeder 53' is preceded by a chip chute 52' an L/W ratio in the range 5-10:1 is appropriate in order to achieve secure filling and emptying of the HP feeder, and chips promotion between the two vessels (3, 60') takes place in all respects in the same manner as in the embodiment described in FIG. 4 through the application of the method of the present invention.

Separation equipment 47' is shown in the drawing at the top of the digester, in which equipment a part of the process fluid in the chips mixture can be withdrawn if this is desirable from the point of view of the process. This withdrawn fluid is made visible by the line $LIQ_C$. According to the innovative concept, this withdrawn process fluid $LIQ_C$ is not returned to the HP feeder as a transport fluid, but there are otherwise no limitations on the use of this fluid. Depending on the cooking method, it can be led back to the input or to the impregnation vessel or in other cases it can be led forwards in the system and added as a cooking fluid in the lower zones of the digester.

In cases in which impregnation with black liquor is applied, the withdrawn process fluid $LIQ_C$ can be partially or fully led away for the recycling of its chemicals.

A certain amount of compression of the chips is obtained as a consequence of the high static pressure that is present at the bottom of the impregnation vessel 3. This compression is not obtained in a chip chute. One measure of the concentration of chips that is present at a certain position is constituted by the degree of filling that is present. A degree of filling of 100% corresponds to the concentration of chips that is obtained when a container is filled with non-deformed pieces of chip without any forced packing, where fluid is subsequently added to the container such that the fluid fills the spaces that are present between the pieces of chip, while the pieces of chip retain the contact with each other in the same manner as if no fluid were present in the container. The degree of filling for stable feed of chips in a chip chute normally lies at approximately 50-85%, while degrees of filling have been measured at the bottom of the impregnation vessel under stable conditions of operation of up to 110% due to the increased degree of packing that is obtained there. This means that an increased capacity of the HP feeder that is directly proportional to the degree of filling is obtained.

Alternative Embodiments

With the HP feeder located after a chip chute, it has been traditional to arrange the HP feeder such that filling of the same takes place from above when a pocket in its first position has a vertical axis of symmetry. However, the method according to the invention is not limited to this manner of filling the HP feeder, and filling can also take place when the axis of symmetry of the pocket is in a horizontal position. This may be particularly appropriate when the HP feeder is arranged subsequent to an impregnation vessel. Since impregnation vessels are normally placed on the ground, due to their size, it is not obvious that there is sufficient space available for filling of the HP feeder from above. If the impregnation vessel is provided with a bottom scraper, the motor of this scraper will be located centrally under the bottom of the impregnation vessel, which probably results in it becoming necessary to place the HP feeder to one side of the vertical axis of symmetry of the impregnation vessel, and thus it is no longer obvious that the best manner of filling the HP feeder is from above. Horizontal filling may be appropriate in this case, while it may also be relevant to consider filling from below.

Figure 6:
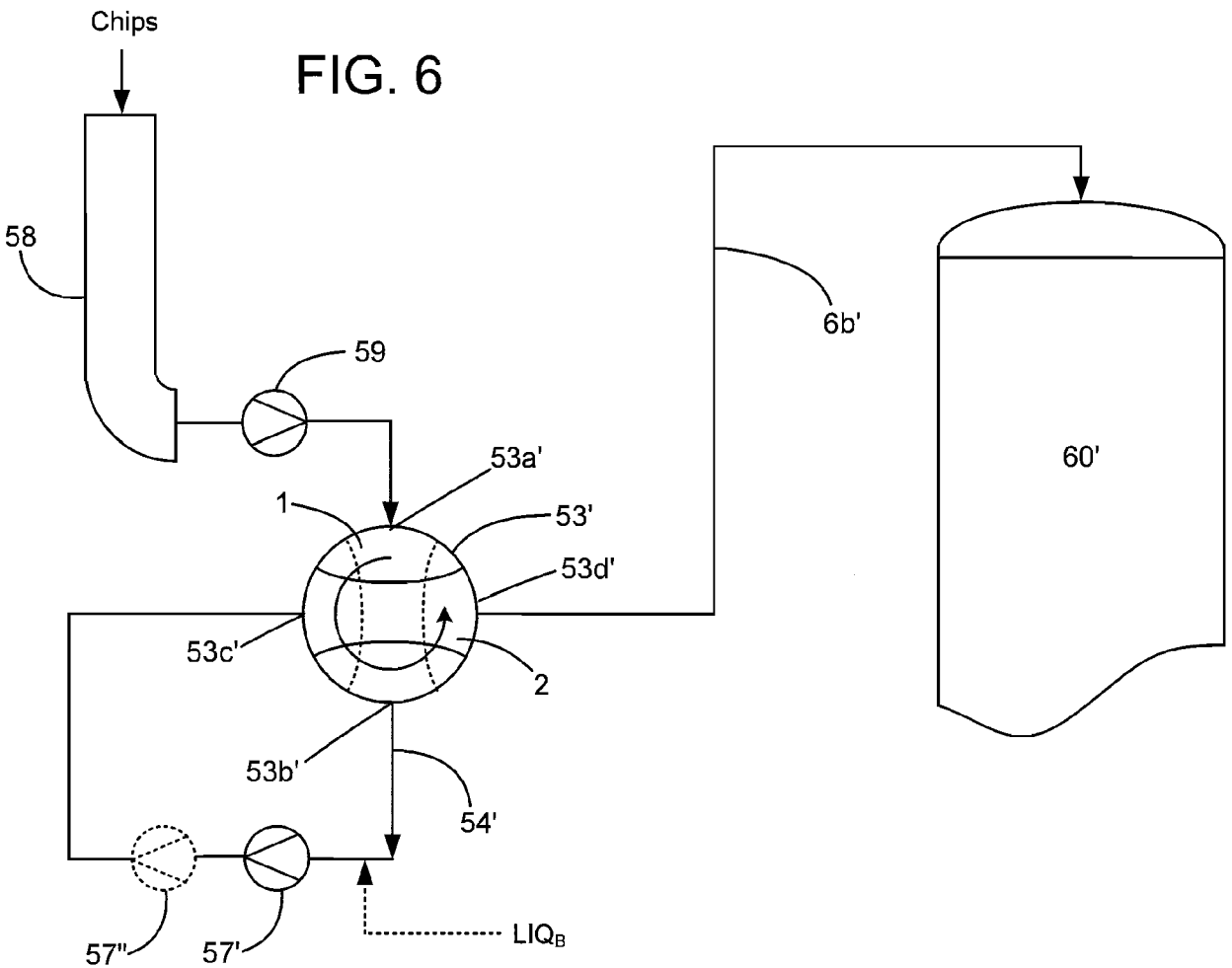
FIG. 6 shows a second alternative embodiment according to the present invention.

The method may also be applied in a feed system according to the variation shown in FIG. 6. Reference numerals in this drawing are the same as those in FIG. 4 to the extent that the same equipment is denoted The principle of force-feeding of the HP feeder 53' is applied in this feed system with the aid of a pump 59 or other type of force-feed such as, for example, a screw. Supply of chips to this pump can take place from a chip chute 58 with horizontal output of chips, but supply of chips to this pump 59 can also take place from an impregnation vessel according to the embodiment that is described in FIG. 5.

When the chips mixture is fed via the HP feeder and the transfer line to the top of the digester, it may be desirable to exchange process fluid at the top of the digester. However, it should be pointed out that the method according to the invention does not require the exchange of process fluid at this position. The process fluid that is separated from the chips in the top separator can be returned to another position in the process and, depending on how the process is designed, the process fluid can be used in both preceding and in subsequent sections of the process. If the fluid withdrawn from the top separator is impregnation fluid, it may be appropriate to return this fluid to the impregnation vessel. It is also the case that the impregnation fluid is, in general, rich in hemicellulose, and thus it may be desirable to seek to reprecipitate this hemicelulose onto the cellulose fibres in the digester, which means that the impregnation fluid can instead be added at the final phase of the cooking stage. A combination of the two positions at which it is added can also be envisaged. Further, it will be clear to one skilled in the arts that the method according to the invention is not limited to these manners of using the withdrawn process fluid, and that the use of this fluid does not constitute any characteristic of the innovative concept in any way other than that it is not to be returned to the HP feeder in order to be used as transport fluid in the transfer line.

Thus the method can be applied in all types of digester system such as single-vessel and double-vessel digester systems of both steam phase and hydraulic types; digester systems with black liquor impregnation (BLI); modified digester systems (MCC, EMCC, Lo-Solids), and ITC; and it can be used during the manufacture of cellulose pulp according to both the sulphite method and the sulphate method. In the same way, deciduous wood, conifer wood, annuals (such as bagasse, reed canary grass, etc.) can constitute the raw material for cellulose.

While the present invention has been described in accordance with preferred compositions and embodiments, it is to be understood that certain substitutions and alterations may be made thereto without departing from the spirit and scope of the following claims.

The invention claimed is:

1. A method for feeding a slurry of cellulose chips and fluid from a low-pressure system to a high-pressure system during a continuous cooking of chemical cellulose pulp, comprising:

providing an impregnation vessel, the impregnation vessel having an outlet defined therein at a bottom of the impregnation vessel;

providing a digester in operative engagement with the impregnation vessel via a sluice feeder disposed between the impregnation vessel and the digester, the sluice feeder having a first inlet, a second inlet, a first outlet, and a second outlet defined therein, the first inlet being in operative engagement with the first outlet and an outlet of the impregnation vessel, and the second inlet being in operative engagement with the second outlet, the first inlet and the first outlet being in operative engagement with the low pressure system, the second inlet and the second outlet being in operative engagement with the high pressure system, the sluice feeder having a rotor with a first pocket and a second pocket, the first and second pockets being movable into a first position and a second position, the first pocket being in connection with the low-pressure system when in the first position while the second pocket being in connection with the high-pressure system, the pockets being alternately placed into connection with the high-pressure system and the low-pressure system where the first pocket, when located in the first position, is in operative engagement with the impregnation vessel via the first inlet, extending a re-circulation line from the first outlet to the second inlet, the re-circulation line having a high pressure pump separating a low pressure portion of the re-circulation line upstream of the pump from a high pressure portion of the re-circulation line downstream of the pump, filling the impregnation vessel with cellulose chips in an upper and lower section thereof, the cellulose chips having spaces defined therebetween, filling the impregnation vessel with a fluid in the lower section of the impregnation vessel to form a superior column of cellulose chips and fluid so that the fluid fills the spaces between the cellulose chips in the lower section while the cellulose chips disposed in the fluid retain a contact with each other in a manner as if no fluid was present in the impregnation vessel, the superior column creating a static pressure at the bottom of the impregnation vessel to compress the cellulose chips to obtain a degree of filling between 100% and up to 110%, using the static pressure of the superior column, without using a forced flow of fluid, to expel a chips mixture of the cellulose chips and the fluid to move out through the outlet and into the first pocket of the sluice feeder, filling the first pocket with the chips mixture while at the same time expelling an expulsion fluid that is present in the first pocket via the first outlet into the low-pressure portion of the re-circulation line, expelling previously filled chips mixture from the second pocket for transporting the chips mixture onwardly in a transfer line to the digester in the high-pressure system, the high-pressure pump pumping fluid, from the low-pressure portion of the re-circulation line to the high-pressure portion of the re-circulation line and into the second inlet, rotating the rotor so that the first and second pockets are moved from their first position to their second position, using the fluid from the low-pressure portion of the re-circulation line pumped by the high-pressure pump to the second inlet to expel the chips mixture from the first pocket into the transfer line to an upper part of the digester in the high pressure system, and conveying the chips mixture from the upper part of the digester down into the digester.

2. The method according to claim 1 wherein a fluid/wood ratio in the transfer line is essentially the same as a fluid/wood ratio in the impregnation vessel.

3. The method according to claim 1 wherein the method further comprises adding an amount of a makeup fluid that is equivalent to a maximum of 50% of an amount of fluid that is expelled from the pockets of the sluice feeder when the pockets are disposed in the first position.

4. The method according to claim 1 wherein the method further comprises leading return fluid withdrawn from a separation equipment to the impregnation vessel in such an amount that a fluid/wood ratio of between 4-10:1 is obtained in the impregnation vessel.

5. The method according to claim 1 wherein the method further comprises adding a liquid to the impregnation vessel that is connected to the first inlet of the sluice feeder.

6. The method according to claim 5 wherein the method further comprises adding an impregnation fluid or cooking fluid to the impregnation vessel to regulate a liquid-to-wood ratio in the impregnation vessel.

7. The method according to claim 1 wherein a fluid/wood ratio in the impregnation vessel and the transfer line does not exceed a value of 10:1.

8. A method for feeding cellulose chips and fluid during a continuous cooking of chemical cellulose pulp, comprising:

providing an impregnation vessel, the impregnation vessel having an outlet defined therein at a bottom of the impregnation vessel;

providing a treatment vessel in operative engagement with the impregnation vessel via a sluice feeder disposed therebetween, the sluice feeder having a first inlet and a first outlet defined therein connected to a low-pressure system and having a second inlet and a second outlet defined therein connected to a high-pressure system, extending a re-circulation line from the first outlet to the second inlet, the re-circulation line having a high pressure pump, filling the impregnation vessel with cellulose chips to a 100% degree of filling so that the impregnation vessel is filled with the cellulose chips, the cellulose chips having spaces defined therebetween, filling the impregnation vessel with a fluid and cellulose chips to form a superior column so that the fluid fills the spaces between the cellulose chips while the cellulose chips retain a contact with each other in a manner as if no fluid was present in the impregnation vessel, the superior column creating a static pressure at the bottom of the impregnation vessel to compress the cellulose chips to obtain a degree of filling between 100% and up to 110%, using the static pressure of the superior column to expel a chips mixture of the cellulose chips and the fluid out through the outlet and into the first pocket of the sluice feeder, filling the first pocket with the chips mixture while at the same time expelling an expulsion fluid that is present in the first pocket via the first outlet into the low-pressure portion of the re-circulation line, expelling previously filled chips mixture from the second pocket for transporting the chips mixture onwardly in a transfer line to the treatment vessel in the high-pressure system, and the high-pressure pump pumping fluid from the low-pressure portion of the re-circulation line to the high-pressure portion of the re-circulation line and into the second inlet, rotating the rotor so that the first and second pockets are moved from their first position to their second position, using the fluid from the low-pressure portion of the re-circulation line pumped by the high-pressure pump to the second inlet to expel the chips mixture from the first pocket into the transfer line to an upper part of the treatment vessel in the high pressure system.

* * * * *